US010784037B2

(12) United States Patent
Yoshida et al.

(10) Patent No.: US 10,784,037 B2
(45) Date of Patent: Sep. 22, 2020

(54) REACTOR HAVING TEMPERATURE SENSOR ATTACHED TO TERMINAL BASE UNIT

(71) Applicant: FANUC CORPORATION, Minamitsuru-gun, Yamanashi (JP)

(72) Inventors: Tomokazu Yoshida, Yamanashi (JP); Masatomo Shirouzu, Yamanashi (JP); Kenichi Tsukada, Yamanashi (JP)

(73) Assignee: Fanuc Corporation, Yamanashi (JP)

( * ) Notice: Subject to any disclaimer, the term of this patent is extended or adjusted under 35 U.S.C. 154(b) by 0 days.

(21) Appl. No.: 16/031,063

(22) Filed: Jul. 10, 2018

(65) Prior Publication Data

US 2019/0019614 A1 Jan. 17, 2019

(30) Foreign Application Priority Data

Jul. 13, 2017 (JP) ..... 2017-137312

(51) Int. Cl.

| | |
|---|---|
| ***H01F 27/24*** | (2006.01) |
| ***H01F 27/28*** | (2006.01) |
| ***H01F 27/29*** | (2006.01) |
| ***H01F 41/02*** | (2006.01) |
| ***H01F 41/04*** | (2006.01) |
| ***H01F 27/40*** | (2006.01) |
| ***H01F 37/00*** | (2006.01) |
| ***H01F 3/14*** | (2006.01) |

(52) U.S. Cl.

CPC ..... *H01F 27/24* (2013.01); *H01F 3/14* (2013.01); *H01F 27/28* (2013.01); *H01F 27/29* (2013.01); *H01F 27/402* (2013.01); *H01F 37/00* (2013.01); *H01F 41/0206* (2013.01); *H01F 41/04* (2013.01); *H01F 2027/406* (2013.01)

(58) Field of Classification Search

CPC ..... H01F 27/24; H01F 27/28; H01F 27/29; H01F 27/402; H01F 2027/406; H01F 37/00; H01F 3/14; H01F 41/0206; H01F 41/04

USPC ..... 336/5, 105, 178, 170, 179, 212, 192

See application file for complete search history.

(56) References Cited

U.S. PATENT DOCUMENTS 3,479,563 A * 11/1969 Roy ..... H01F 27/402 361/41
3,516,040 A * 6/1970 Ripley ..... H01F 27/402 336/96

(Continued)

FOREIGN PATENT DOCUMENTS

CN 201765902 U 3/2011
CN 208706395 U 4/2019

(Continued)

*Primary Examiner* — Mang Tin Bik Lian
(74) *Attorney, Agent, or Firm* — RatnerPrestia

(57) ABSTRACT

A reactor according to an embodiment of the present disclosure includes a core body that includes an outer peripheral iron core composed of a plurality of outer peripheral iron core portions, at least three iron cores coupled to the outer peripheral iron core portions, and coils wound on the iron cores. A gap is formed between one of the iron cores and another of the iron cores adjacent to the one of the iron cores, so as to be magnetically connectable through the gap. The reactor includes a terminal base unit for electrically connecting the coils to an external device, and a temperature sensor attached to a surface of the terminal base unit, the surface being opposite the coils.

8 Claims, 8 Drawing Sheets

(56) References Cited

U.S. PATENT DOCUMENTS

| | | | | |
|---|---|---|---|---|
| 4,112,405 | A * | 9/1978 | Joseph | H01F 27/402 310/68 C |
| 5,116,246 | A * | 5/1992 | Perry | H01H 85/2045 337/209 |
| 66,185,811 | | 2/2001 | Perry | |
| 2005/0040924 | A1* | 2/2005 | LaBoube | H01F 27/085 336/5 |
| 2008/0197961 | A1* | 8/2008 | Patel | H01F 21/12 336/170 |
| 2009/0243769 | A1* | 10/2009 | Takaya | H01H 50/58 335/127 |
| 2009/0261939 | A1* | 10/2009 | Shudarek | H01F 3/10 336/212 |
| 2012/0106210 | A1 | 5/2012 | Xu et al. | |
| 2013/0187741 | A1* | 7/2013 | Goodrich | H01F 3/10 336/170 |
| 2014/0368059 | A1* | 12/2014 | Sugawara | H01F 27/402 307/117 |
| 2015/0102882 | A1 | 4/2015 | Shudarek | |
| 2016/0125998 | A1 | 5/2016 | Bhide et al. | |
| 2016/0217921 | A1 | 7/2016 | Suzuki et al. | |
| 2017/0084377 | A1 | 3/2017 | Maeda et al. | |
| 2019/0019614 | A1 | 1/2019 | Yoshida et al. | |
| 2019/0385776 | A1* | 12/2019 | Yamamoto | H01F 27/2876 |

FOREIGN PATENT DOCUMENTS

| | | | |
|---|---|---|---|
| DE | 102016010901 | A1 | 3/2017 |
| JP | 49043123 | A | 4/1974 |
| JP | 2000-77242 | A | 3/2000 |
| JP | 2007173702 | A | 7/2007 |
| JP | 2008-210998 | A | 9/2008 |
| JP | 2009-283706 | A | 12/2009 |
| JP | 2012033711 | A | 2/2012 |
| JP | 2016058254 | A | 4/2016 |
| JP | 2017059805 | A | 3/2017 |

* cited by examiner

REACTOR HAVING TEMPERATURE SENSOR ATTACHED TO TERMINAL BASE UNIT

This application is a new U.S. patent application that claims benefit of JP 2017-137312 filed on Jul. 13, 2017, the content of 2017-137312 is incorporated herein by reference.

BACKGROUND OF THE INVENTION

1. Field of the Invention

The present invention relates to a reactor.

2. Description of Related Art

Reactors each have a plurality of iron core coils, and each iron core coil includes an iron core and a coil wound on the iron core. Between the iron cores, predetermined gaps are formed. For example, refer to Japanese Unexamined Patent Publication (Kokai) Nos. 2000-77242 and 2008-210998.

Three-phase reactors having linearly arranged three-phase coils (windings) are known (for example, Japanese Unexamined Patent Publication (Kokai) No. 2009-283706, hereinafter referred to as "Patent Document"). Patent Document discloses a three-phase reactor in which both ends of each of three windings are connected to a pair of terminals, and the reactor is connected to another electric circuit through the pairs of terminals.

There are also, reactors in which the plurality of iron cores and coils wound on the iron cores are disposed inside an outer peripheral iron core, which is composed of a plurality of outer peripheral iron core portions. In such a reactor, each iron core is integrally formed with the respective outer peripheral iron core portion. Between the iron cores adjacent each other at the center of the reactor, predetermined gaps are formed.

SUMMARY OF THE INVENTION

In reactors having an outer peripheral iron core that can be divided into pieces, there is a problem that it is necessary to attach a temperature sensor to each of multiple coils to perform temperature protection for the coils. Further, since it is difficult to attach the sensors to the coils, there is a problem that the degree of difficulty in automating the manufacturing process becomes high.

Therefore, a reactor in which no increase in the number of manufacturing man-hours is required, and in which there is no increase in the degree of difficulty in automating the manufacturing process thereof is desired.

A reactor according to an embodiment of the present disclosure includes a core body that includes an outer peripheral iron core composed of a plurality of outer peripheral iron core portions, at least three iron cores coupled to the outer peripheral iron core portions, and coils wound on the iron cores. A gap is formed between one of the iron cores and another of the iron cores adjacent to the one of the iron cores, so as to be magnetically connectable through the gap. The reactor includes a terminal base unit for electrically connecting the coils to an external device, and a temperature sensor attached to a surface of the terminal base unit, the surface being opposite the coils.

BRIEF DESCRIPTION OF THE DRAWINGS

The objects, features, and advantages of the present invention will be more apparent from the following description of embodiments accompanying with the drawings. In the drawings.

DETAILED DESCRIPTION OF THE INVENTION

Figure 1:
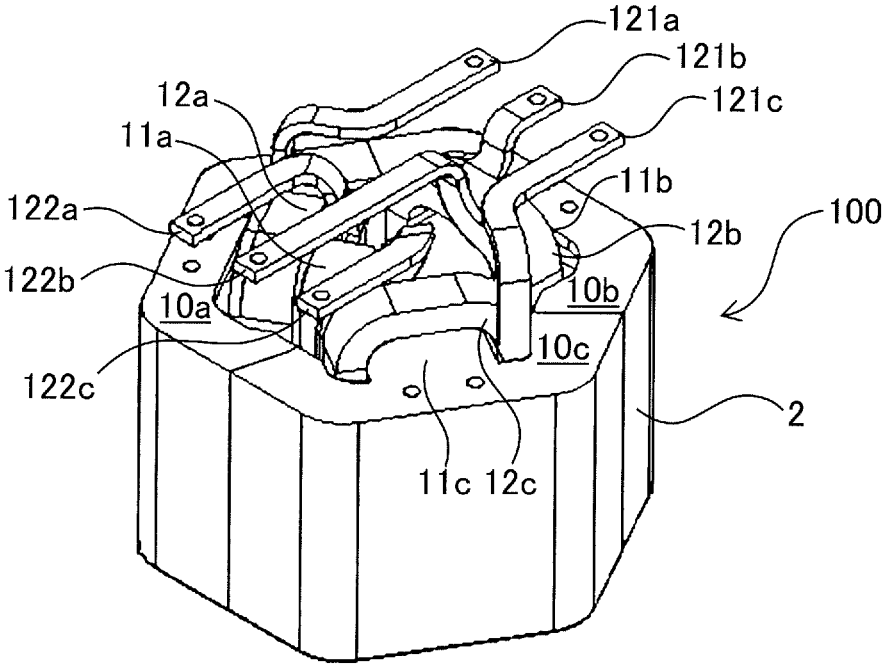
FIG. 1 is a perspective view of a reactor according to a first embodiment, before a terminal base unit is provided.

Embodiments of the present invention will be described below with reference to the accompanying drawings. In the drawings, the same reference numerals indicate the same components. For ease of understanding, the scales of the drawings are modified in an appropriate manner.

The following description mainly describes three-phase reactors as an example, but the present invention is not limited to three-phase reactors, but can be widely applied to multi-phase reactors that require constant inductance in each phase. The reactors according to the present disclosure can be applied to various types of equipment, as well as being applied to primary sides and secondary sides of the inverters in industrial robots and machine tools.

Figure 2:
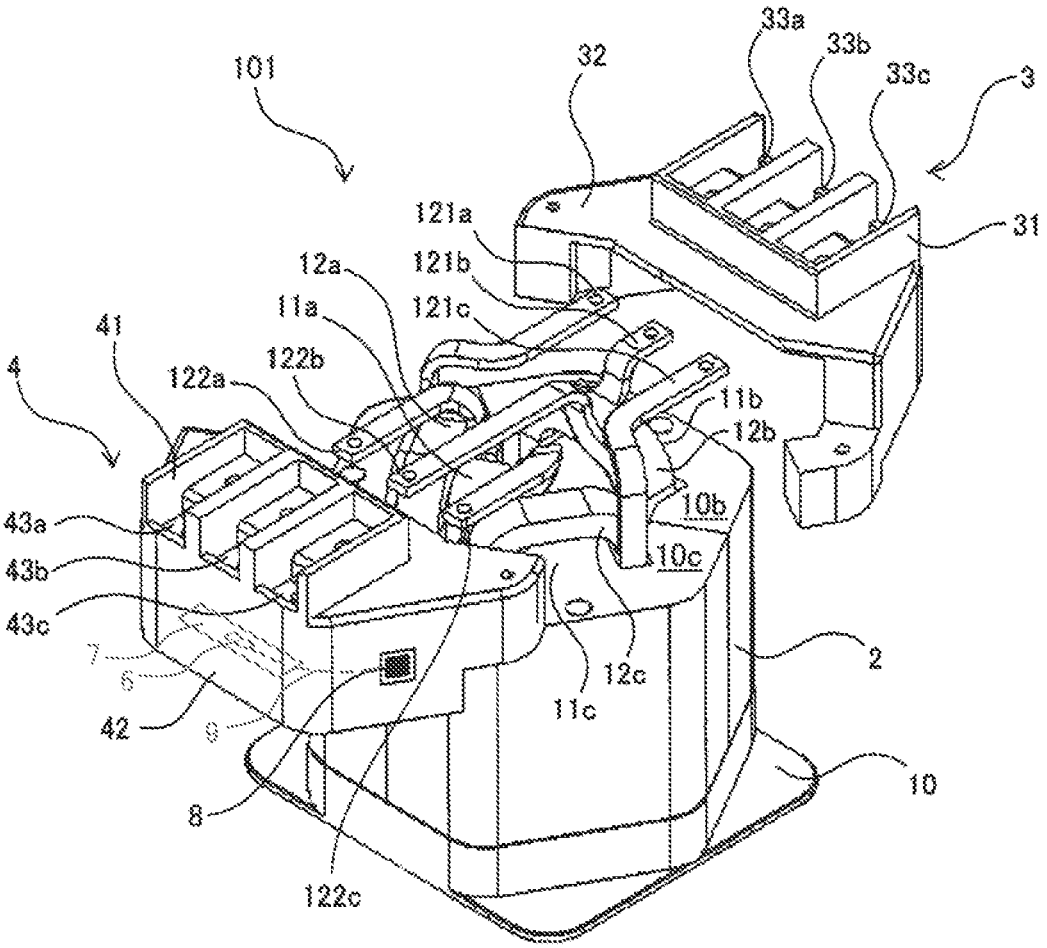
FIG. 2 is a perspective view of the reactor according to the first embodiment, before a first terminal base unit and a second terminal base unit are connected to terminals of coils.
Figure 3:
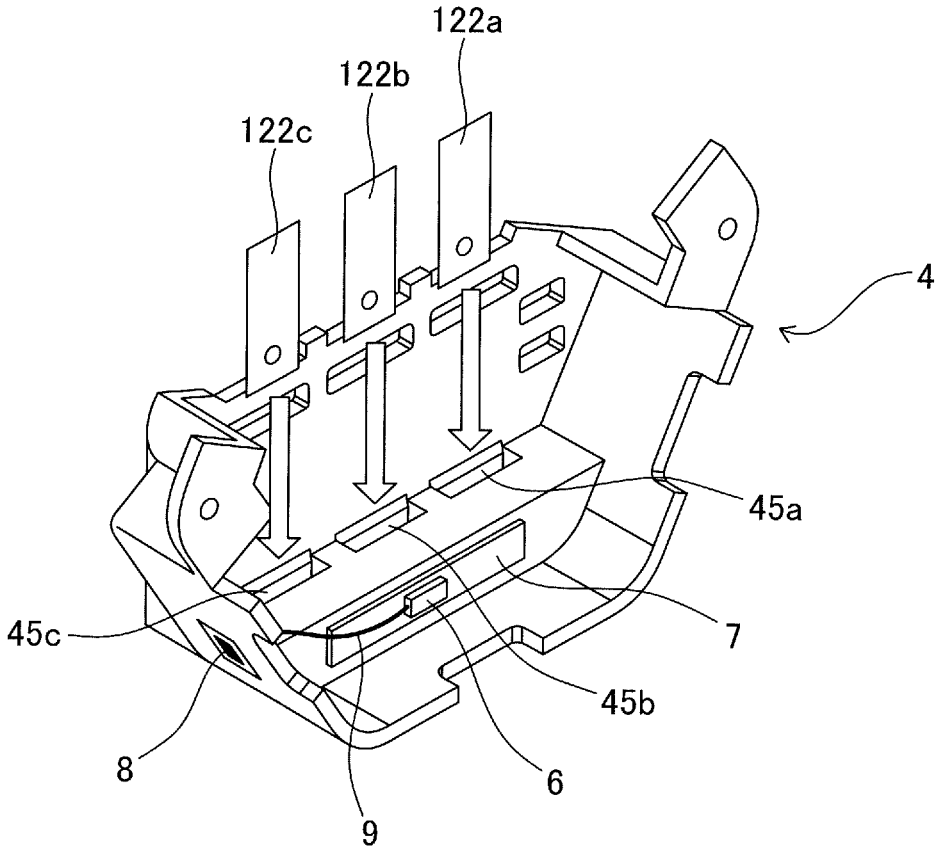
FIG. 3 is a perspective view of the terminal base unit composing the reactor according to the first embodiment.
Figure 4:
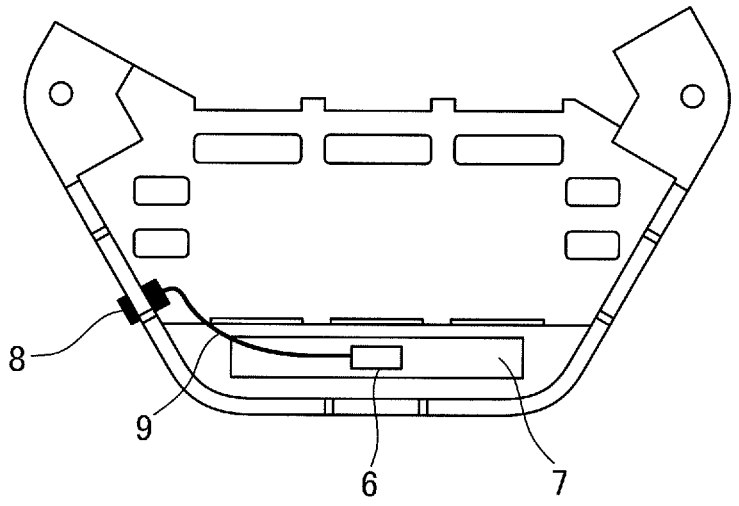
FIG. 4 is a plan view of the terminal base unit composing the reactor according to the first embodiment.

A reactor according to a first embodiment will be described. FIG. 1 is a perspective view of the reactor according to the first embodiment before a terminal base unit is provided. FIG. 2 is a perspective view of the reactor according to the first embodiment before a first terminal base unit and a second terminal base unit are connected to terminals of coils. FIG. 3 is a perspective view of the terminal base unit composing the reactor according to the first embodiment. FIG. 4 is a plan view of the terminal base unit composing the reactor according to the first embodiment.

The reactor according to the first embodiment includes a core body 100. The core body 100 includes an outer peripheral iron core 2 composed of a plurality of outer peripheral iron core portions (10*a*, 10*b*, and 10*c*), at least three iron cores (11*a*, 11*b*, and 11*c*) coupled to the outer peripheral iron core portions (10*a*, 10*b*, and 10*c*), and coils (12*a*, 12*b*, and 12*c*) wound on the iron cores (11*a*, 11*b*, and 11*c*). The outer peripheral iron core 2 and the outer peripheral iron core portions (10*a*, 10*b*, and 10*c*) are made of laminations of iron sheets, carbon steel sheets, or electromagnetic steel sheets, ferrite, amorphous, or pressed powder cores.

A gap (not shown) is formed between one of the iron cores (11*a*, 11*b*, and 11*c*) and another of the iron cores adjacent to the one of the iron cores, so as to be magnetically connectable through the gap. The number of the iron cores is preferably an integral multiple of 3.

A terminal base unit may include a first terminal base unit 3 having first connection portions (33*a*, 33*b*, and 33*c*) connected to input terminals (121*a*, 121*b*, and 121*c*) of the coils, and a second terminal base unit 4 having second connection portions (43*a*, 43*b*, and 43*c*) connected to output terminals (122*a*, 122*b*, and 122*c*) of the coils. The first terminal base unit 3 and the second terminal base unit 4 that are combined into one terminal base unit, as shown in FIG. 2, will be described as an example. However, the present invention is not limited to this example. The terminal base unit may be composed of one or three or more components.

The terminal base units (3 and 4) electrically connect the coils (12*a*, 12*b*, and 12*c*) to an external device. More specifically, the terminal base units (3 and 4) include terminal bases (31 and 41) to electrically connect the terminals (121*a*, 121*b*, 121*c*, 122*a*, 122*b*, and 122*c*) of the coils (12*a*, 12*b*, and 12*c*) to the external device, and cover the coils (12*a*, 12*b*, and 12*c*). To be more specific, the first terminal base unit 3 and the second terminal base unit 4 cover the coils (12*a*, 12*b*, and 12*c*) in a state of being coupled to each other.

As shown in FIGS. 3 and 4, in a reactor 101 according to the first embodiment, a temperature sensor 6 is attached to the surface of the terminal base unit (3 or 4) opposite the coils (12*a*, 12*b*, and 12*c*). As the temperature sensor, for example, a thermistor may be used. However, the present invention is not limited to this example, and another temperature sensor may be used. The terminal base unit (3 or 4) is provided with a connector 8 that is electrically connected to the temperature sensor 6 and establishes connection with the external device. The temperature sensor 6 is electrically connected to the connector 8 provided in the terminal base unit (3 or 4) through a wire 9. The external device can obtain data related to a temperature detected by the temperature sensor 6 through the connector 8. Providing the temperature sensor in the terminal base unit enables indirect estimation of heat generation of the coils.

Protection against temperature using a temperature sensor may be applied to other applications, in addition to the reactor. For example, the present invention provides protection against abnormal heat generation due to faulty screwing between the terminal base and the cable in the reactor.

The temperature sensor 6 is preferably disposed on a metal plate 7 provided in an inner surface of the terminal base unit (3 or 4) opposite the coils (12*a*, 12*b*, and 12*c*). The metal plate 7 enables securing of the temperature sensor 6 to the terminal base unit (3 or 4). Furthermore, the metal plate 7 enables a reduction in the thermal resistance between the temperature sensor 6 and the terminal base unit (3 or 4).

FIGS. 3 and 4 show an example in which the temperature sensor 6 is provided in the second terminal base unit 4, but the temperature sensor 6 may be provided in the first terminal base unit 3 instead. Furthermore, both of the first terminal base unit 3 and the second terminal base unit 4 may be provided with the temperature sensor 6. Furthermore, the first terminal base unit 3 or the second terminal base unit 4 may be provided with a plurality of temperature sensors.

The coils (12*a*, 12*b*, and 12*c*) have input terminals (121*a*, 121*b*, and 121*c*) and output terminals (122*a*, 122*b*, and 122*c*), respectively. For example, the coils (12*a*, 12*b*, and 12*c*) may be an R-phase coil, an S-phase coil, and a T-phase coil, respectively. However, the present invention is not limited to this example. The input terminals (121*a*, 121*b*, and 121*c*) and the output terminals (122*a*, 122*b*, and 122*c*) preferably have holes at their terminal end portions, to establish connections with connection portions of the terminal bases, as described later.

As shown in FIG. 1, the outer peripheral iron core portions (10*a*, 10*b*, and 10*c*) are not arranged in a line. If the terminals of the coils (12*a*, 12*b*, and 12*c*) extend as is in the longitudinal direction of the reactor 101, the terminals are not arranged in a line, thus making it difficult to establish connections with the terminal bases. Therefore, the input terminals (121*a*, 121*b*, and 121*c*) preferably extend in directions perpendicular to the longitudinal direction of the reactor 101, so as to arrange the terminal end portions of the input terminals (121*a*, 121*b*, and 121*c*) in a line. The output terminals (122*a*, 122*b*, and 122*c*) preferably extend in directions that are perpendicular to the longitudinal direction of the reactor 101 and are opposite to the input terminals (121*a*, 121*b*, and 121*c*), so as to arrange the terminal end portions of the output terminals (122*a*, 122*b*, and 122*c*) in a line. As shown in FIG. 1, when the longitudinal direction of the reactor 101 is perpendicular to the ground, the input terminals (121*a*, 121*b*, and 121*c*) and the output terminals (122*a*, 122*b*, and 122*c*) preferably extend in the horizontal direction with respect to the ground. Since the input terminals (121*a*, 121*b*, and 121*c*) and the output terminals (122*a*, 122*b*, and 122*c*) extend in the directions perpendicular to the longitudinal direction of the reactor, the height of the reactor can be short and small in the longitudinal direction of the reactor, as compared with the case of extending the terminals in the longitudinal direction of the reactor.

Furthermore, since the terminal end portions of the input terminals (121*a*, 121*b*, and 121*c*) and the terminal end portions of the output terminals (122*a*, 122*b*, and 122*c*) are arranged in lines, the input terminals (121*a*, 121*b*, and 121*c*) and the output terminals (122*a*, 122*b*, and 122*c*) can be easily connected to the terminal base units.

The first terminal base unit 3 has a first terminal base 31 and a first covering portion 32. The first terminal base 31 and the first covering portion 32 are preferably integrally formed. The second terminal base unit 4 has a second terminal base 41 and a second covering portion 42. The second terminal base 41 and the second covering portion 42 are preferably integrally formed. The first terminal base unit 3 and the second terminal base unit 4 are preferably made of an insulating material, e.g., plastic, etc.

The first terminal base unit 3 has first connection portions (33*a*, 33*b*, and 33*c*) to be connected to the input terminals (121*a*, 121*b*, and 121*c*), respectively. The second terminal base unit 4 has second connection portions (43*a*, 43*b*, and 43*c*) to be connected to the output terminals (122*a*, 122*b*, and 122*c*), respectively. The first connection portions (33*a*, 33*b*, and 33*c*) are preferably made of a conductive material, to establish electrical connections with the input terminals (121*a*, 121*b*, and 121*c*), respectively. In the same manner, the second connection portions (43*a*, 43*b*, and 43*c*) are preferably made of a conductive material, to establish electrical connections with the output terminals (122*a*, 122*b*, and 122*c*), respectively.

The first connection portions (33*a*, 33*b*, and 33*c*) have holes. The holes are aligned with holes formed in the input terminals (121*a*, 121*b*, and 121*c*), and thereafter are fastened with screws, etc. In the same manner, the second connection portions (43*a*, 43*b*, and 43*c*) have holes. The holes are aligned with holes formed in the output terminals (122*a*, 122*b*, and 122*c*), and thereafter are fastened with screws, etc.

Figure 5:
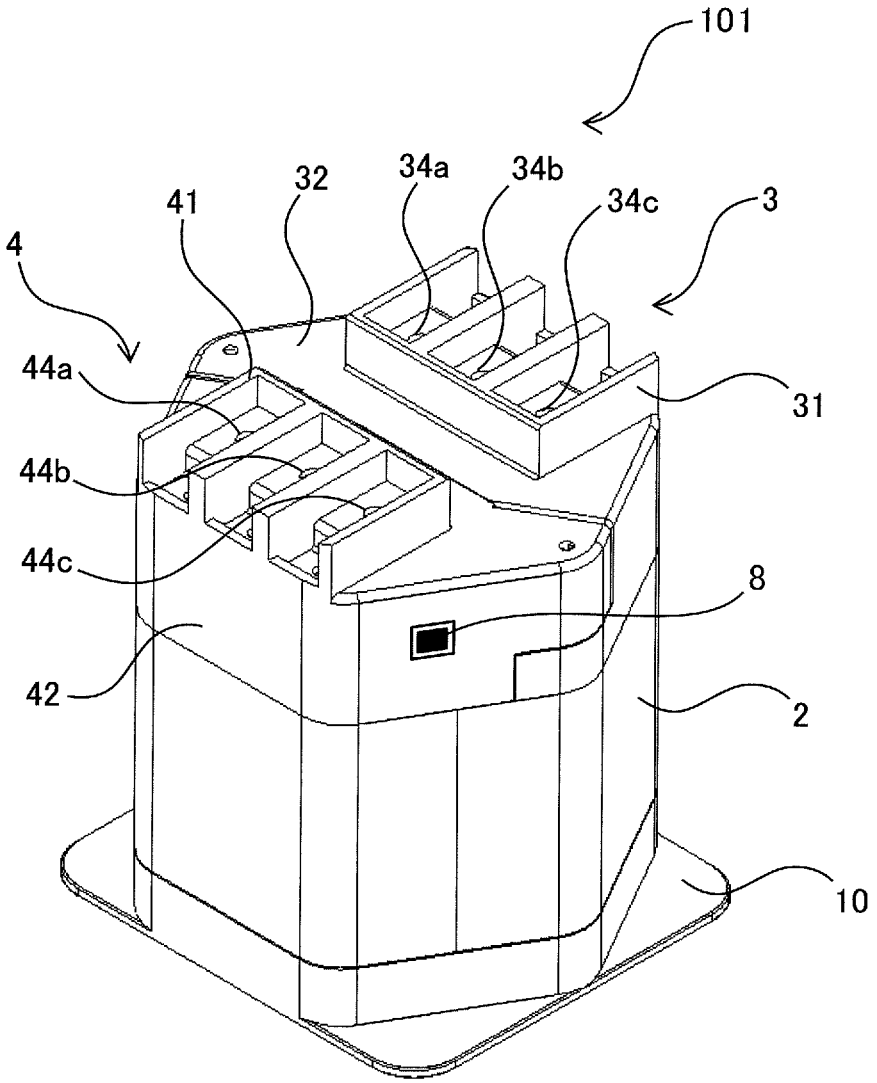
FIG. 5 is a perspective view of the reactor according to the first embodiment, after the first terminal base unit and the second terminal base unit have been connected to the terminals of the coils.

FIG. 5 is a perspective view of the reactor according to the first embodiment after the first terminal base unit and the second terminal base unit have been connected to the terminals of the coils. The first terminal base unit 3 and the second terminal base unit 4 are preferably coupled to each other without any gap, in a state of being connected to the input terminals (121*a*, 121*b*, and 121*c*) and the output terminals (122*a*, 122*b*, and 122*c*), respectively. According to this structure, the first terminal base unit 3 and the second terminal base unit 4 can prevent the coils (12*a*, 12*b*, and 12*c*) from being exposed to the outside, thus enabling insulation and protection of the coils (12*a*, 12*b*, and 12*c*). An external device can be easily connected to the input terminals (121*a*, 121*b*, and 121*c*) and the output terminals (122*a*, 122*b*, and 122*c*), as compared with the case of directly connected thereto.

Furthermore, the outer peripheral shape of the first terminal base unit 3 and the second terminal base unit 4 coupled together is preferably the same as that of the outer peripheral iron core 2. The first terminal base unit 3 and the second terminal base unit 4 are preferably disposed on the outer peripheral iron core 2 without any gap. According to this structure, the first terminal base unit 3 and the second terminal base unit 4 can be stably disposed on the outer peripheral iron core 2. As a result, even when the reactor vibrates, the connections between each of the connection portions of the terminal bases and each of the input and output terminals of the coils are prevented from breaking due to the vibration, etc.

The first terminal base unit 3 and the second terminal base unit 4 that have once been coupled can be separated. According to this structure, as compared with the case of using general-purpose terminal bases, the reactor can be easily disassembled, and the terminal bases can be easily exchanged.

The first terminal base unit 3 has first terminals (34*a*, 34*b*, and 34*c*) to be connected to an external device. The second terminal base unit 4 has second terminals (44*a*, 44*b*, and 44*c*) to be connected to the external device. The first terminals (34*a*, 34*b*, and 34*c*) are electrically connected to the first connection portions (33*a*, 33*b*, and 33*c*), respectively. The second terminals (44*a*, 44*b*, and 44*c*) are electrically connected to the second connection portions (43*a*, 43*b*, and 43*c*), respectively. As a result, the external device can be electrically connected to the coils (12*a*, 12*b*, and 12*c*) through the first terminals (34*a*, 34*b*, and 34*c*) and the second terminals (44*a*, 44*b*, and 44*c*).

The first terminals (34*a*, 34*b*, and 34*c*) are preferably arranged in a line, and the second terminals (44*a*, 44*b*, and 44*c*) are preferably arranged in a line. This structure facilitates connection between the reactor 101 and the external device.

As shown in FIG. 3, the second terminal base unit 4 has openings (45*a*, 45*b*, and 45*c*). By passing the output terminals (122*a*, 122*b*, and 122*c*) of the coils (12*a*, 12*b*, and 12*c*) through the openings (45*a*, 45*b*, and 45*c*) from the inside to the outside of the second terminal base unit 4, the output terminals (122*a*, 122*b*, and 122*c*) can be electrically connected to the second connection portions (43*a*, 43*b*, and 43*c*), respectively.

As shown in FIG. 2, the output terminals (122*a*, 122*b*, and 122*c*) extend in a direction perpendicular to the longitudinal direction of the reactor. Therefore, the reactor has an advantage in that the step of passing the output terminals (122*a*, 122*b*, and 122*c*) through the openings (45*a*, 45*b*, and 45*c*) of the second terminal base unit 4 in the extending direction of the output terminals (122*a*, 122*b*, and 122*c*) can be easily automated.

As shown in FIG. 2, the input terminals (121*a*, 121*b*, and 121*c*) extend in a direction perpendicular to the longitudinal direction of the reactor. Therefore, the reactor has an advantage in that the step of passing the input terminals (121*a*, 121*b*, and 121*c*) through the openings of the first terminal base unit 3 in the extending direction of the input terminals (121*a*, 121*b*, and 121*c*) can be easily automated.

Figure 6A:
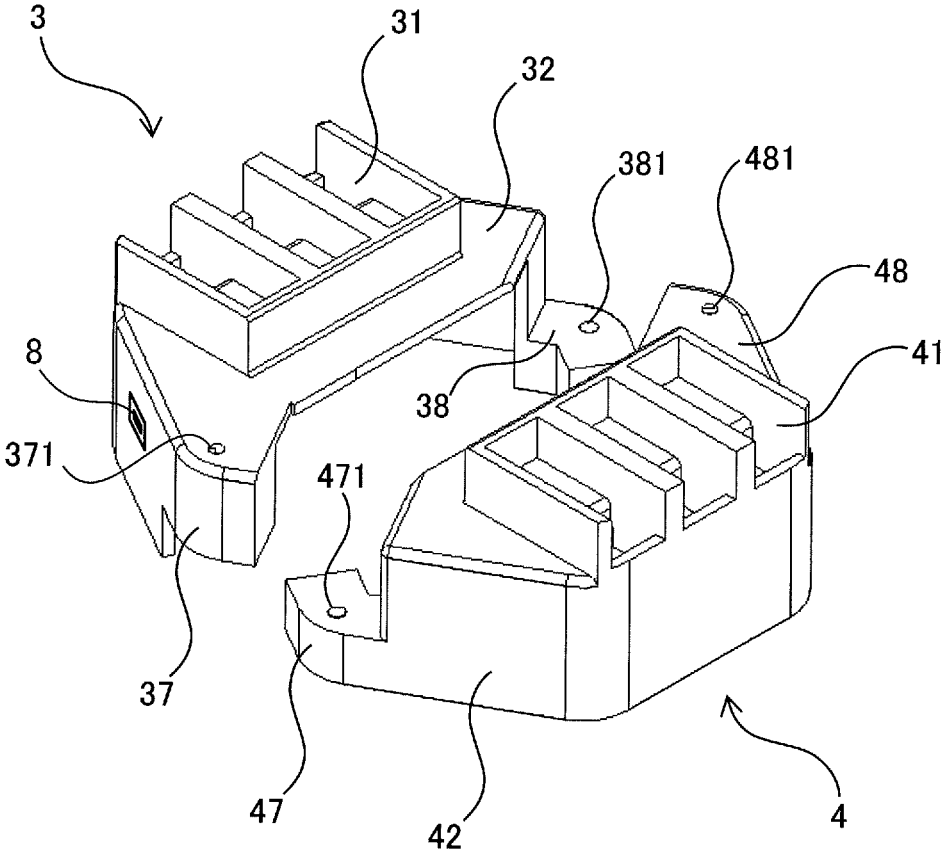
FIG. 6A is a perspective view of the first terminal base unit and the second terminal base unit, which constitute the reactor according to the first embodiment, before being coupled together.
Figure 6B:
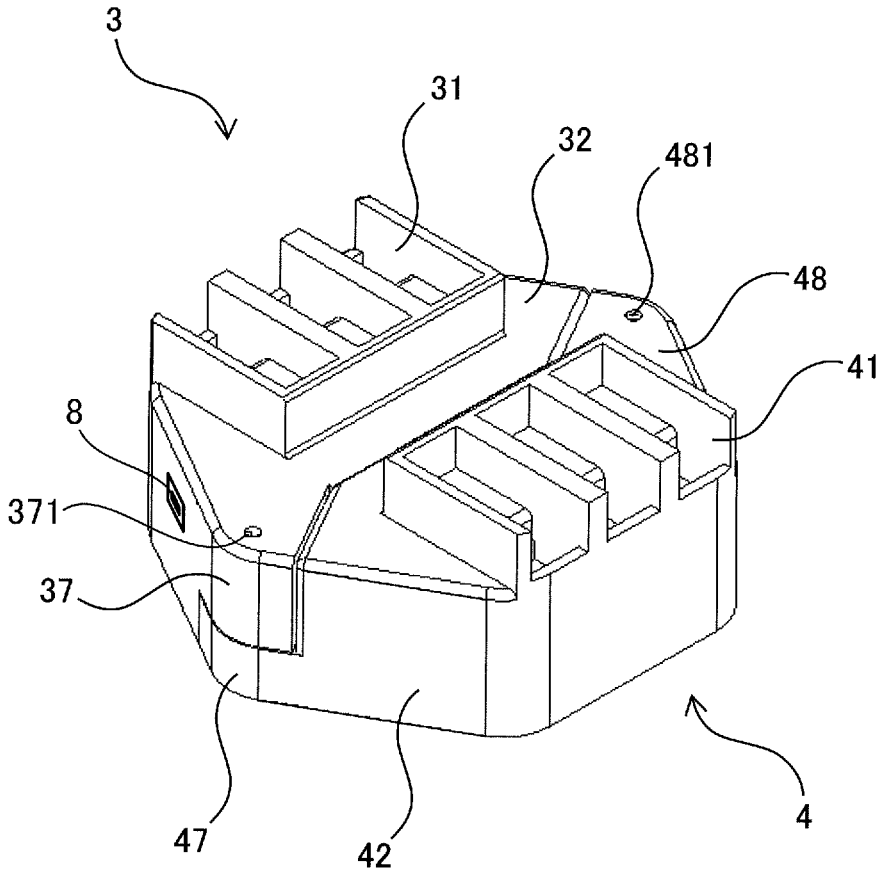
FIG. 6B is a perspective view of the first terminal base unit and the second terminal base unit, which constitute the reactor according to the first embodiment, after being coupled together.

FIG. 6A is a perspective view of the first terminal base unit 3 and the second terminal base unit 4, which constitute the reactor according to the first embodiment, before being coupled together. FIG. 6B is a perspective view of the first terminal base unit 3 and the second terminal base unit 4, which constitute the reactor according to the first embodiment, after being coupled together. The first terminal base unit 3 has first coupling portions (37 and 38), and the second terminal base unit 4 has second coupling portions (47 and 48) to be coupled to the first coupling portions (37 and 38).

For example, the first coupling portions (37 and 38) include a first upper coupling portion 37 and a first lower coupling portion 38. The second coupling portions (47 and 48) include a second upper coupling portion 48 and a second lower coupling portion 47.

The first upper coupling portion 37 is coupled to the second lower coupling portion 47. When the first upper coupling portion 37 is coupled to the second lower coupling portion 47, a through hole 371 formed in the first upper coupling portion 37 is preferably aligned with a through hole 471 formed in the second lower coupling portion 47 in the horizontal plane, so as to form one continuous through hole. The first upper coupling portion 37 and the second lower coupling portion 47 can be secured using the continuous through hole. To secure the first upper coupling portion 37 and the second lower coupling portion 47, for example, a screw may be screwed into the through holes 371 and 471, or a through-rod may be inserted into the through holes 371 and 471.

The first lower coupling portion 38 is coupled to the second upper coupling portion 48. When the first lower coupling portion 38 is coupled to the second upper coupling portion 48, a through hole 381 formed in the first lower coupling portion 38 is preferably aligned with a through hole 481 formed in the second upper coupling portion 48 in the horizontal plane, so as to form one continuous through hole. The first lower coupling portion 38 and the second upper coupling portion 48 can be secured using the continuous through hole. To secure the first lower coupling portion 38 and the second upper coupling portion 48, for example, a screw may be screwed into the through holes 381 and 481, or a through-rod may be inserted into the through holes 381 and 481.

The first terminal base unit 3 and the second terminal base unit 4 preferably have the same structure. This enables the use of one type of terminal base unit in common as the first terminal base unit 3 and the second terminal base unit 4, thus resulting in an increase in efficiency of an assembly operation, and a reduction in manufacturing cost of the terminal base unit.

Figure 7:
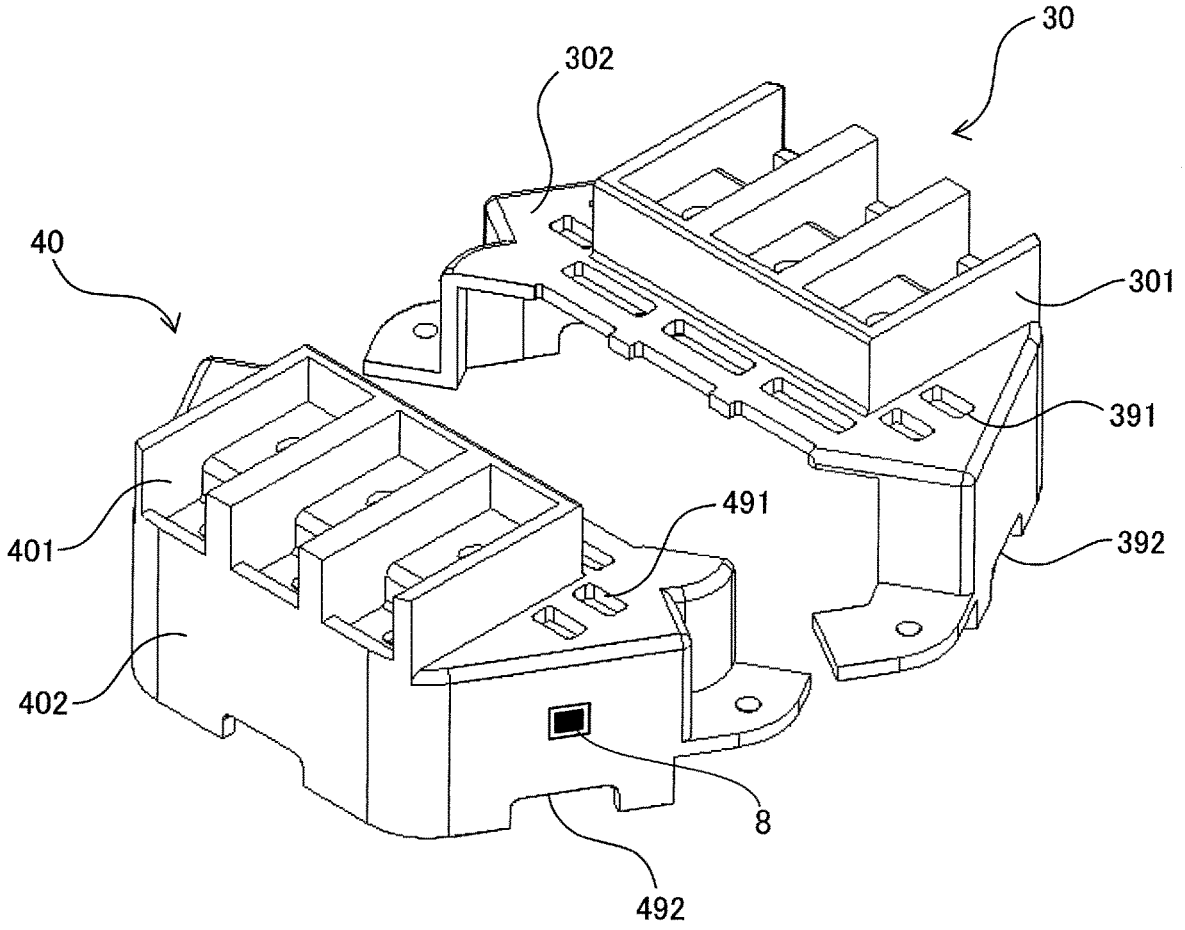
FIG. 7 is a perspective view of a first terminal base unit and a second terminal base unit composing a reactor according to a modification example of the first embodiment.

FIG. 7 is a perspective view of a first terminal base unit and a second terminal base unit composing a reactor according to a modification example of the first embodiment. At least one of a first terminal base unit 30 and a second terminal base unit 40 may have slits.

In the top surface of a first covering portion 302 of the first terminal base unit 30, first top surface slits 391 are formed in the vicinity of a first terminal base 301. Furthermore, in the bottom surface of the first covering portion 302 of the first terminal base unit 30, first bottom surface slits 392 are formed.

In the top surface of a second covering portion 402 of the second terminal base unit 40, second top surface slits 491 are formed in the vicinity of a second terminal base 401. Furthermore, in the bottom surface of the second covering portion 402 of the second terminal base unit 40, second bottom surface slits 492 are formed.

When the first terminal base unit 30 and the second terminal base unit 40 are coupled together and disposed on an outer peripheral iron core 2, since outside air is drawn through the first bottom surface slits 392 and the second bottom surface slits 492, and discharged through the first top surface slits 391 and the second top surface slits 491, the heat generated by coils (12*a*, 12*b*, and 12*c*) can be released to the outside.

In FIG. 7, the rectangular slits are formed in the first terminal base unit 30 and the second terminal base unit 40, but the present invention is not limited to this example. Slits of another shape, e.g., round slits, etc., may be provided instead. Furthermore, the slits are formed in the top and bottom surfaces of the first terminal base unit 30 and the second terminal base unit 40, but the present invention is not limited to this example, and slits may be formed in the side surfaces.

The reactor according to the modification example of the first embodiment has increased heat dissipation efficiency for the heat generated by the coils, while providing insulation and protection of the coils, using the first terminal base unit 30 and the second terminal base unit 40.

In the above description, the terminals (121*a*, 121*b*, and 121*c*) are assigned as input terminals, and the terminals (122*a*, 122*b*, and 122*c*) are assigned as output terminals, but the present invention is not limited to this example. The terminals (121*a*, 121*b*, and 121*c*) may be assigned as output terminals, and the terminals (122*a*, 122*b*, and 122*c*) may be assigned as input terminals.

Figure 8:
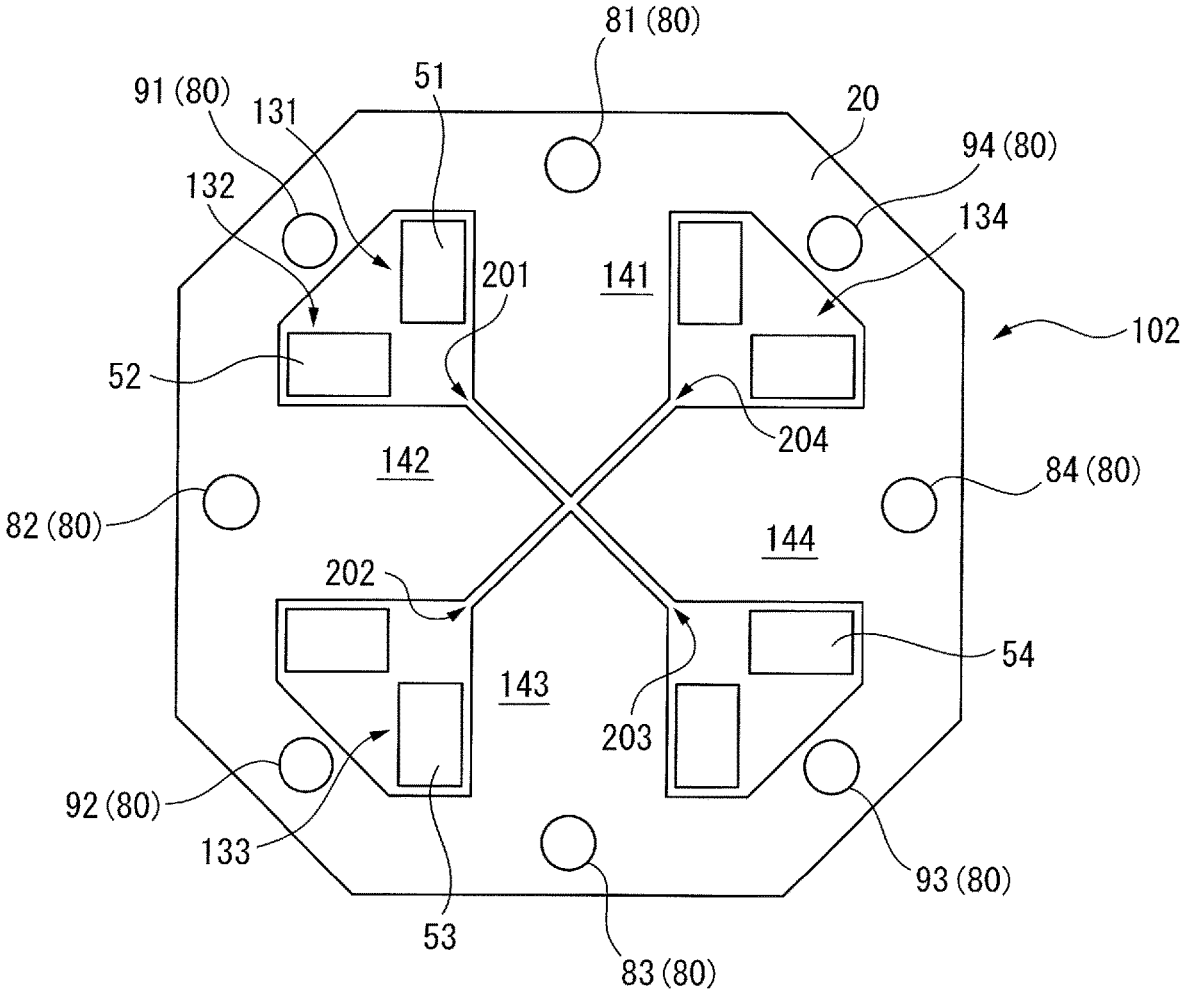
FIG. 8 is a cross sectional view of a reactor according to a second embodiment.

Next, a reactor according to a second embodiment will be described. FIG. 8 is a cross-sectional view of a reactor 102 according to the second embodiment. In FIG. 8, the reactor 102 includes an approximately octagonal outer peripheral iron core 20, and four outer peripheral iron core portions 131 to 134 contacting or coupled to an inner surface of the outer peripheral iron core 20. The outer peripheral iron core portions 131 to 134 are disposed at approximately equal intervals in the circumferential direction of the reactor 102. The number of iron cores is preferably an even number of 4 or more, whereby the reactor 102 can be used as a single-phase reactor.

As is apparent from FIG. 8, the outer peripheral iron core portions 131 to 134 include iron cores 141 to 144 and coils 51 to 54 wound on the iron cores, respectively. The iron cores 141 to 144 contact the outer peripheral iron core 20 or are integrally formed with the outer peripheral iron core 20, at their radial outer end portions.

Furthermore, the radial inner end portions of the iron cores 141 to 144 are positioned in the vicinity of the center of the outer peripheral iron core 20. In FIG. 8, the iron cores 141 to 144 converge toward the center of the outer peripheral iron core 20 at their radial inner end portions, each having an edge angle of approximately 90 degrees. The radial inner end portions of the iron cores 141 to 144 are separated from each other by gaps 201 to 204, to be magnetically connectable therethrough.

In the reactor 102 shown in FIG. 8, a cooling unit 80 is preferably provided in at least one of positions 81 to 84 corresponding to the radial outer end portions and intermediate positions 91 to 94. According to this structure, since the cooling unit is disposed in an end surface of the outer peripheral iron core, the reactor can be cooled with high efficiency with a simple structure without an increase in size.

It is not necessary to attach a temperature sensor to each coil of the reactors according to the embodiments of the present disclosure. The number of sensors can be reduced, thus enabling a cost reduction. Furthermore, the reactors provide ease of attachment of the temperature sensor, and ease of automation of the manufacturing process.

What is claimed is:

1. A reactor comprising:

a core body including:

an outer peripheral iron core composed of a plurality of outer peripheral iron core portions;

at least three iron cores coupled to the outer peripheral iron core portions; and coils wound on the iron cores;

a gap formed between one of the iron cores and another of the iron cores adjacent to the one of the iron cores, so as to be magnetically connectable through the gap;

a terminal base unit for electrically connecting terminals of the coils to an external device, wherein the terminal base unit includes an integrally formed covering portion configured to completely cover the coils and an entire upper surface of the cores; and a temperature sensor attached to an inner surface of the terminal base unit and configured to detect a temperature of heat generation of the coils, wherein the detected temperature is provided to the external device, and the inner surface being opposite the coils.

2. The reactor according to claim 1, wherein the temperature sensor is disposed on a metal plate provided in the inner surface of the terminal base unit, the inner surface being opposite the coils.

3. The reactor according to claim 1, wherein the terminal base unit includes:

a first terminal base unit having first connection portions connected to input terminals of the coils; and a second terminal base unit having second connection portions connected to output terminals of the coils, wherein the temperature sensor is attached to at least one of the first terminal base unit and the second terminal base unit.

4. The reactor according to claim 1, wherein the terminal base unit includes a connector electrically connected to the temperature sensor, and the connector establishes a connection to the external device.

5. The reactor according to claim 3, wherein the first terminal base unit and the second terminal base unit have the same structure.

6. The reactor according to claim 3, wherein heat dissipation slits are formed in the terminal base unit.

7. The reactor according to claim 1, wherein the number of the iron cores is an integral multiple of 3.

8. The reactor according to claim 1, wherein the number of the iron cores is an even number of 4 or more.

* * * * *